United States Patent [19]

Yung et al.

[11] 4,163,819

[45] Aug. 7, 1979

[54] DRAPEABLE NONWOVEN FABRICS

[75] Inventors: Kai-Lim W. Yung; Bernard Silverman, both of Raleigh, N.C.

[73] Assignee: Monsanto Company, St. Louis, Mo.

[21] Appl. No.: 864,883

[22] Filed: Dec. 27, 1977

[51] Int. Cl.[2] ..... B05D 1/14; B32B 7/14

[52] U.S. Cl. ..... 428/198; 264/122; 264/171; 264/248; 428/373; 428/374

[58] Field of Search ..... 428/288, 198, 373, 374; 264/126, 122, 171, 248; 260/857, 78 A, 78 L

[56] References Cited

U.S. PATENT DOCUMENTS

| | | | |
|---|---|---|---|
| 3,522,329 | 7/1970 | Okazaki et al. | 260/857 |
| 3,622,442 | 11/1971 | Reardon | 428/288 |
| 3,862,262 | 1/1975 | Hedrick et al. | 260/78 A |
| 3,944,629 | 3/1976 | Hedrick et al. | 260/78 L |
| 3,993,806 | 11/1976 | Athey | 428/288 |
| 4,031,164 | 6/1977 | Hedrick et al. | 260/78 L |
| 4,034,015 | 7/1977 | Hedrick et al. | 260/78 L |

FOREIGN PATENT DOCUMENTS

| | | | |
|---|---|---|---|
| 49-47422 | 12/1974 | Japan | 264/126 |

*Primary Examiner*—Jay H. Woo

*Attorney, Agent, or Firm*—Howard C. Stanley; Herman O. Bauermeister

[57] ABSTRACT

The present invention relates to non-woven fabrics characterized by excellent drapeability, very pleasant handle and good tensile properties. The fabrics are made from melt blends of a polyamide together with lactam-polyol-polyacyl lactam or acyl-polylactam terpolymers.

The production of the non-woven webs or fabrics from melt blended fibers of polyamide with lactam-polyol-polyacyl lactam or acyl-polylactam terpolymers is achieved by contact or thermal bonding of melt spun fibers. In one embodiment of the invention, the webs are formed from fibers in the nascent condition as freshly extruded, e.g., they are substantially amorphous. Such amorphous fibers are readily bonded even at room temperature, resulting in autogenous self-bonding, with only little pressure being imposed. If desired these fibers may be bonded at temperatures of up to 210° C. Crystallization of the nascent, amorphous fibers is retarded by the presence of the polyol content of the terpolymer and the subsequent sorption of water plasticizes and causes additional fiber tackiness before significant crystallization occurs.

In another aspect of the invention the fibers are not nascent, e.g., fibers stored for some time with the natural development of crystallinity before forming fibers into non-woven fabrics. The thermal bonding step can be carried out at 200° C. to 250° C. to form a non-woven fabric of excellent drapeability.

For the two embodiments of the invention the temperature range is broadly from 20° C. to 250° C.

20 Claims, No Drawings

DRAPEABLE NONWOVEN FABRICS

BACKGROUND OF THE INVENTION

1. Field of the Invention

This invention in one embodiment relates to a method for contact bonding of lactam-polyol-polyacyl lactam or acyl-polylactam terpolymers as melt blends of said terpolymers with polyamides in filament forms by means of amorphous state contacting to achieve the bonding to an integral web. This is preferably followed by crystallization of the contacted fibers. The invention thus relates to a method for producing non-woven webs having autogenous, crossing point bonding of the individual fibers or filaments at temperatures of up to 210° C. and preferably 20° C. to 210° C.

In yet another aspect, this invention relates to the above contact bonding of lactam terpolymers and/or melt blends of said terpolymers with polyamides in the presence of water, followed by drying and crystallization while the fibers are in contact with one another.

In the above embodiment of this invention there is a retardation of crystallization of nascent, amorphous fibers of the melt blends of said block terpolymers with polyamides, said retardation of crystallization resulting from the presence of the polyol portion of the terpolymer.

However, in the embodiment of this invention with non-nascent, e.g., crystallized fibers, similar non-woven fabrics of excellent drapeability are obtained when such melt blended fibers are contacted under thermal bonding conditions such as 200° C. to 250° C.

In the present description, the term melt blend refers to a combination of polymers such as polyamide together with a lactam terpolymer which are melted together for fiber extrusion or other processing. Thus a mixture of the ground powders or pellets of the respective polymers are melted, for example, in an extruder, and after passage through the extruder screw are passed into fiber or film dies or into molds for the production of shaped articles.

2. Description of the Prior Art

The fibers or filaments comprising a non-woven fabric have in the past been bonded by the use of external binders or by softening the fibers with heat, solvent or plasticizer and subjecting them to substantial pressure while in the softened state. The external binder may be an adhesive substance which is cured after the application thereof or it may be rendered adhesive after application by use of heat, solvent or plasticizer. External binders may be applied as powders, solutions, emulsions or even in the form of fibers; however, these methods suffer from several disadvantages. The use of an outside binder presents problems in uniform applications and limits the properties of the entire web to those of the binder. Thus, for example, if a fiber with a relatively low melting point is used as a bonding material, the temperature conditions to which the web or resulting fabric may be subjected, are limited by the melting point of the binder fibers.

Solvent bonding of the previous methods is not easily controlled and frequently tends to alter the aesthetic properties of the web. For example, achieving adequate adhesiveness in the filaments without dissolving the entire web or at least impairing the physical properties thereof is difficult. Furthermore, the intersections at which the filaments are bonded frequently have a swollen appearance which evidences the solution and redeposition of polymer which is referred to as polymer migration. In most instances, these swollen areas around the bonds do not possess the same dye acceptance level because of changes in the crystalline structure which is localized at the bonds sites thereby causing non-uniform dyeing.

Because of the low cost of non-wovens, continued work is progressing to produce fabrics which have the lower cost of non-woven fabrics, while achieving the properties of woven fabrics. Non-woven fabrics commonly are made by mixing fibers of staple length and depositing the fibers as a continuous sheet or web. The fibers in web form are then bonded together, for example, by the application of various known binders or binding techniques such as thermal or pressure means. The binding means is selected in order to give good bonding to a variety of different fibers so uniform bonding throughout the web will be achieved. To obtain a fabric with reasonable strength, it has been necessary to employ substantial proportions of adhesive binders, substantial pressure or heat and the like; however, the high concentration of binders, excessive pressure or heat produce fabrics which are stiff rather than soft and supple due to the low degree of movement or slip between the individual fibers of the resulting fabrics.

To improve the hand of non-woven fabrics, it has been proposed to apply new bonding techniques which achieve improved hand while maintaining strength properties. It has been suggested to employ adhesive bondings which are rubbery or plastic in nature so that bonding extensibility will be achieved through the deformation of the binder at the point of contact between fibers. This approach has resulted in limited improvement in hand of the fabric; however, it has not been totally successful in matching the characteristics of woven fabrics in non-wovens.

Contact bonding of the nascent nylon 66 fibers fails to occur since nylon 66 crystallizes very rapidly.

SUMMARY OF THE INVENTION

Provided herein is a method for the production of non-woven fabrics in which bonding of the synthetic filaments or fibers is achieved without the use of adhesives, and/or excessive pressure. In the following description the term "fibers" includes filaments, staple fibers and yarns thereof. According to one embodiment of the invention, it has been observed that polyamides, such as nylon 66 in a melt blend with a lactam terpolymer, particularly those derived from lactam-polyol-polyacyl lactam or acyl polylactam terpolymers, yield fibers which are in substantially amorphous state after melt spinning, and the nascent fibers are sufficiently tacky to bond autogenously when at a temperature less than the melt temperature of the crystalline portion of the terpolymer. Therefore, these fibers can be bonded to each other upon simple contacting without application of substantial pressure or heat. Permanent contact bonding is achieved when the fibers are allowed to crystallize in contact with one another. When the fibers subsequently become crystalline, the tackiness disappears, but any adhesion or bonding which has occurred before and during crystallization remains.

According to this embodiment of the invention, a method for producing nonwoven fabrics from lactam terpolymers or melt blends of said terpolymer with polyamides is provided whereby the fibers of said terpolymers or melt blends in a nascent, non-crystalline state are contact bonded. These nascent, amorphous fibers are allowed to crystallize while they are in contact with one another thus resulting in a contact bonded web. Normally nylon 66 fibers would not be in a substantially amorphous state because of the ability of the fibers to proceed in crystallization approaching an equilibrium crystalline-amorphous physical state. According to this invention, if the fiber contains at least 0.1 weight % polyol (based on the total fiber weight) derived from the lactam terpolymer, the presence of this polyol retards crystallization. In general, the present invention employs at least 0.1 weight % polyol content in the product. A preferred range is 0.1 to 35 weight %, and a more preferred range is 0.5 to 35 weight %.

In addition, exposure of the amorphous fibers to water plasticizes and causes additional tackiness. Crystallization and loss of tackiness occurs upon drying. Water may be sorbed from a vapor or upon immersion in a bath. The substantially non-crystalline, nascent fibers, are brought into contact with each other at a temperature of 20° C. to 210° C. which is below the melt temperatures of the crystalline polyamides contained in the terpolymers of melt blends, with the contact bonding of the fibers resulting as the fibers are permitted to crystallize, thus forming a permanent contact bond. Crystallization of the fibers can be accelerated by annealing and other means after the fibers have been contacted under nascent amorphous conditions.

Annealing as preferably employed in the nascent embodiment is the process by which a polymeric substance in shaped form, such as synthetic fibers is brought to its equilibrium morphological state. It normally involves heating the polymeric substance either in a stressed or relaxed state to a temperature between the glass transition and melting temperatures, or in general, from 10° C. to 150° C. above the preceding temperature of web bonding. Annealing is desirable because it accelerates the process of crystallization and/or improves the degree of crystallinity. After annealing, the polymeric substance has an improved balance of physical properties.

In the embodiment using non-crystalline fibers, the self-bonding behavior of these non-crystalline fibers of the melt blends of said terpolymers with polyamides, and the resulting bonded nonwoven web is considered to be possible as a result of the retarded crystallization rate of the terpolymer or melt blends thereof. These terpolymers when spun into fiber form and exposed to moisture, pick up the moisture rapidly. Pressure of course can be applied if desired in strengthening permanent bonds; however, such pressure is not necessary. The contact bonding according to the invention is carried out with substantially small pressure force, e.g., from 1 to 100 pounds per linear inch (pli) being applied.

It will be appreciated that the fibers as used in the nascent embodiment of the invention must remain in their substantially amorphous state for a time sufficient to allow adhesion between fibers to occur, before substantial crystallization sets in and the tackiness of the fibers therefore disappears. After bonding the fibers may be heated to anneal them in a completely relaxed condition or under a controlled tension.

In the embodiment of the invention in which the fibers are used in a crystalline state, e.g., a non-nascent condition, the bonding of the fibers is conducted at a temperature of 200° C. to 250° C. to obtain non-woven fabrics. Such fabrics are also characterized by excellent drapeability, good hand and physical properties.

In addition, bonding of the crystalline, e.g., non-nascent fibers, is improved by contacting the fibers with water as described herein. Such treatment is conducted before making fabrics by the bonding technique.

However, in both embodiments of the invention it has been observed that the melt blend of a polyamide and the lactam block terpolymers produce fibers which in a non-woven web, when contacted or firmly bonded with one another are cohesively bonded together. This particular characteristic of the lactam block terpolymers or melt blends with polyamides when exposed to water in any form is envisioned to be due to plasticization of the fibers by the water.

The fabrics of the invention are useful in carpet backing, lining fabrics, drapery fabrics and many other textile and industrial applications.

Other synthetic fibers such as rayon as well as natural fibers, e.g., cotton which are not necessarily tacky under the process conditions may be disposed between the fibers of the web and therefore become incorporated in the nonwoven fabric. Such other fibers become incorporated in the web either by adhesion to the tacky fibers, or by being maintained in position by the bonded fibers. If desired, additional bonding between the dispersed fibers as well as between the bonded and the dispersed fibers can be brought about by known bonding means.

DETAILED DESCRIPTION OF SPECIFIC EMBODIMENTS OF THE INVENTION

The following examples illustrate specific embodiments of the invention with Examples 1–4 being directed to the contact bonding of nascent e.g. amorphous fibers.

The production of non-woven webs from fibers of lactam-polyol-polyacyl lactam or acyl polylactam terpolymers or melt blends of said terpolymers with nylon 66 is achieved by contact bonding of the melt spun, nascent fibers at temperatures below the melt temperatures of crystalline portions of the fibers. The terpolymers utilized are prepared by an anionic catalyzed polymerization with a polyester initiator and the terpolymers are formed from dicarboxylic acid esters and aliphatic polyols and/or aliphatic polyether polyols. These ester terminated terpolymers are comprised of 30 percent by weight polyol, so that the compositions listed below range from 7.5% to 30 wt. % polyol in the product. Polymer components of the fibers are ground to a size range of from 10 to 20 mesh followed by mixing. Extrusion is achieved through the use of a screw extruder having a ¾ inch diameter and a length to diameter ratio of 20 to 1 at temperatures of from 250° C. to 285° C. as indicated in Examples 1 through 4 of the following table. Melt spinning is through a 10 hole spinnerette having capillaries of 9 mil diameter and lengths of 12 mil. The melt spun fibers are then passed through attenuators at 40 psig compressed air pressure and are then deposited on the conveying belt. Webs comprised of fibers of about 3 to 5 denier are thus produced. The fibers are bonded by pressing under slight pressure of from about 10 to about 20 pli (pounds per linear inch). In general the pressure for bonding nascent fibers is from 1 to 100 pli.

Examples 1–4 in the following table set out the blend composition by weight percent, extrusion temperatures, and extrusion rates for four webs produced according to the contact bonding methods of the invention. The resulting nonwoven webs indicate a bonding strength estimated to have a strip tenacity of greater than about 1.5 poisy (1.5 pound per inch per ounce per square yard). The webs or fabrics are surprisingly strong and possess good hand and drapeability.

TABLE

| Example Number | Fiber Composition % by Weight | Extrusion Temp., °C. | Extrusion Rate gm/hole/minute |
|---|---|---|---|
| 1. | 100% Lactam Terpolymer (30% Polyol) | 250 | 0.20 |
| 2. | 75% Lactam Terpolymer 25% Nylon 66 (22.5% Polyol) | 275 | 0.27 |
| 3. | 50% Lactam Terpolymer 50% Nylon 66 (15% Polyol) | 280 | 0.20 |
| 4. | 25% Lactam Terpolymer 75% Nylon 66 (7.5% Polyol) | 285 | 0.24 |

EXAMPLES 5–9

The following examples are directed to the crystalline (non-nascent) embodiments of the invention.

Examples 5–9 illustrate the specific embodiments of the invention using non-nascent e.g. substantially crystalline melt-blended fibers of polyamide (specifically nylon 66) and a lactam terpolymer. The lactam terpolymer used for these examples contains 30% polyol content. The melt blends of the said two components are obtained by mixing them together in a screw extruder having a ¾" diameter screw, and a length to diameter ratio of 20:1 at temperatures of from 250° C. to 285° C. Before melt blending, each of the polymer components in pellet form is ground to a size ranging from 10 to 20 mesh, the two polymers are then mixed together in the proportion such that the total mix contains 12% polyol by weight. The melt blend from the extruder is then fed to the spinning pack which is made up of a six hole spinnerette of 9 mil diameter and 12 mil length. The fiber bundles from the spinnerette are then strung through a pair of aspirators which draw the fibers and deposit them randomly on a conveying wire screen. The web weights, as shown in the table, are controlled by the speed of the conveying screen. The web obtained on the screen is stored on paper bobbins for a period of about a month. During this period the melt blended fibers crystallize substantially. Non-woven fabrics are obtained from webs of these melt blended fibers by heat pressing on an embosser at a temperature of from 213° C. to 230° C., under 110 lbs. per linear inch pressure at a speed of 15 ft. per minute. The embosser used has a discontinuous pattern with an area coverage of about 10%.

The above parameters are used to characterize the fabrics. Strip tenacity is measured as a tensile test using an Instron Test Instrument with a gage length of 5 inches.

The zero-span test is conducted on the same instrument as a tensile test with a gage length of zero. Bonding efficiency is the ratio of strip tenacity to zero-span tenacity, expressed in percentage. The trap tear value is also measured on the Instron instrument. This parameter characterizes the resistance of the fabric to tear. The higher the value is, the more resistant the fabric is to tearing. The binding modulus is a parameter derived from the hand measurements. It characterizes the drapeability of the fabric. The smaller the bending modulus, the more drapeable is the fabric. The parameter of the initial modulus is obtained from the initial slope of the stress and strain curve. It is a measure of the resistance of the fabric to deformation, when subjected to a tensile load initially.

In both embodiments of the invention other synthetic fibers such as rayon as well as natural fibers, e.g., cotton which are not necessarily tacky under the process conditions may be disposed between the fibers of the web and therefore become incorporated in the nonwoven fabric. Such fibers become incorporated in the web either by adhesion to the tacky fibers, or by being maintained in position by the bonded fibers. If desired, additional bonding between the dispersed fibers as well as between the bonded fibers can be brought about by known bonding means.

The fabrics of the invention are useful in carpet backing, lining fabrics, drapery fabrics and many other textile and industrial applications.

EXAMPLES 10 TO 13

In order to illustrate that the non-woven fabrics of the invention have excellent drape and hand, the physical properties of some woven and knitted fabrics are shown in the following table for comparison. These woven and knitted fabrics as described in the table were obtained commercially. With the parameters such as initial modulus and bending modulus to characterize the properties of drape and hand of the fabric, one can see that the non-woven fabrics of the invention are superior to the two woven fabrics, and are comparable to the two knitted fabrics in drape and hand properties.

TABLE

| | EX. 10 | EX. 11 | EX. 12 | EX. 13 |
|---|---|---|---|---|
| Material and Construction | 65-35-PET-Cotton Combed broadcloth Shirting | Acetate Satin (woven) | Nylon Tricot (knit) | Interlock knit (knit) |

TABLE

Non-Woven Fabric From Crystalline Combinations of a Polyamide (Nylon 66) With a Lactam Terpolymer (12% Polyol Content)

| | Example 5 | Example 6 | Example 7 | Example 8 | Example 9 |
|---|---|---|---|---|---|
| Embossing Temperature | 213° C. | 213° C. | 220° C. | 225° C. | 230° C. |
| Fabric Weight (oz/yd$^2$) | .82 | 1.4 | .90 | 1.0 | .80 |
| Machine Direction: | | | | | |
| Strip Tenacity (PIOSY) | 7.2 | 7.9 | 7.6 | 6.8 | 6.1 |
| Zero Span Tenacity (PIOSY) | 14.6 | 11.5 | 11.0 | 12.0 | 8.7 |
| Trap Tear (POSY) | 6.2 | 7.7 | 7.3 | 4.3 | 3.9 |
| Elongation (%) | 52.5 | 71.5 | 50.8 | 56.6 | 43 |
| Initial Modulus (PIOSY) | 15.4 | 12.7 | 10.9 | 13.4 | 16.0 |
| Bonding Efficiency (%) | 49.7 | 68.6 | 69.1 | 57.0 | 69.0 |
| Bending Modulus | 4.8 | 8.2 | 9.0 | 9.1 | 10.6 |

(PIOSY indicates pounds per inch per ounce per square yard, and POSY indicates pounds per ounce per square yard).

TABLE-continued

| | EX. 10 | EX. 11 | EX. 12 | EX. 13 |
|---|---|---|---|---|
| | (woven) | | | |
| Fabric wt. (ounces per sq. yard) | 3.2 | 3.2 | 2.2 | 3.3 |
| Machine direction strip tenacity (PIOSY) | 20.3 | 13.5 | 16.0 | 12.9 |
| zero span tenacity (PIOSY) | 26.3 | 15.2 | 23.8 | 17.1 |
| Trap tear (POSY) | 5.7 | 3.0 | 11.0 | 5.6 |
| Elongation (%) | 42.2 | 13.9 | 153.0 | 114.7 |
| Initial Modulus (PIOSY) | 340.1 | 349.9 | 40.0 | 19.6 |
| Bending Modulus | 59.3 | 660.3 | 3.2 | 1.1 |

Another embodiment of the invention is the use of the melt-blend of a polyamide and the lactam terpolymers with another polymer component to form composite articles such as side by side bicomponent, or sheath core fibers, e.g. with the said melt blend as the sheath, and the other polymer component as the core. These fibers are useful in non-woven fabrics. The said melt blend used for the aforesaid purposes should contain at least 0.1 wt.% polyol, and should comprise at least 5% by weight in the composite article. Polymers such as polyamides e.g. nylon 66, polyesters e.g. polyethylene terephthalate or other polymer melt blends, etc. can be physically combined with the said melt blend of the polyamide and the lactam terpolymer to form the composite articles. If desired, additives such as flame retardant agents, e.g. tri(2,3 dibromopropyl) phosphate can also be employed in either of the physical components of the composite fiber to achieve certain desired properties.

The polyol content in the melt blend of the polyamide-lactam terpolymer retards the crystallization of the melt blend, thus allowing contact bonding of the nascent composite fibers.

For the non-nascent composite fibers of this invention, thermal bonding at temperatures preferably from 200° to 250° C. result in useful non-woven fabrics.

The general method for the production of the composite articles comprises forming a melt stream of a blend of a polyamide and a lactam terpolymer, which blend has at least 0.1 wt. % polyol content, and also forming a melt stream of another polymeric substance, specifically polyethylene terephthalate or nylon 66, and extruding the said two melt streams together in the configuration for example as a sheath core, a side by side composite fiber or other shaped article. The said composite product has at least 5% by weight of the said blend in the total composite article. Preferred embodiments of the invention are sheath core fibers for example with the blend of the polyamide and the lactam terpolymer as the sheath, and with the other polymeric substance, preferably polyethylene terephthalate or nylon 66 as the core of the sheath core fiber. Another preferred embodiment is a side by side composite fiber with the aforesaid components as the two side by side members.

Another embodiment of the invention is the use of the composite article such as sheath core or side by side composite fibers as used in the production of non-woven fabrics. For this purpose the fibers are produced as described above and are then assembled such as by random deposition on a moving belt to form a web. The web is then heat pressed. When utilizing the nascent type of the said composite fibers the contact pressing temperature is from 20° to 210° C. In the embodiment using the non nascent composite fibers, the heat pressing temperature is from 200° C. to 250° C.

EXAMPLE 14

As an example of this embodiment of the invention, a composite sheath core fiber is formed utilizing as the sheath, 30% by wt. of the melt blend of nylon 66 (as 60 parts by weight) and a lactam terpolymer (as 40 parts by weight). The core component is polyethylene terephthalate.

These composite fibers are deposited in a random pattern as a web to provide a non-woven fabric of 2.2 oz. per yd. The fabric is bonded on an embosser having 196 bond points per inch comprising about 10% of the surface area. The temperature of the heated roll used in embossing is about 220° C. Such a web has a strength of 3 lbs. per inch per oz. per sq. yd.

In the present invention, an improvement has been made in the novel aspect that the presence of the terpolymer in the melt blend retards crystallization of the polyamide and thus makes possible the contact bonding of the nascent melt blended fibers. In contrast to the present nascent melt blended fibers, polyamide fibers, such as nylon 66, because of the rapid crystallization rate, do not contact bond together.

Another aspect of novelty in the process of the invention is the production of nonwoven fabrics with comparable hand and drape properties to woven or knitted fabrics. Consequently, the invention achieves woven-like properties of nonwoven fabrics at far lower costs than would be required for woven or knitted fabrics. This is a major advantage of this invention over other nonwoven processes.

Polyamides as employed herein comprise the self-polymerization products of monoaminomonocarboxylic acids. These polyamides can be obtained by the methods given in U.S. Pat. No. 2,241,322 and by other methods, for example, by self-polymerization of a monoaminomonocarboxylic acid, or by self-polymerization of a cyclic amide, it being understood that reference herein to the amino acids is intended to include the equivalent amide-forming derivatives of those acids. Also included are linear polyamides derived from suitable diamines by the reaction with suitable dibasic carboxylic acids or their amide-forming derivatives. One of the most widely used polyamides of this classification is the hexamethylene adipamide, commonly identified as Nylon 6,6.

The second component of the present melt blends is a lactam terpolymer or more specifically a terpolymer of lactam-polyol-polyacyl lactam or lactam polyol-acyl-polylactam.

These terpolymers can be additionally characterized by as having ester, amide, and/or hydroxy end group termination, as well as both ester linkages and amide linkages between monomeric segments thereof. The terpolymers may be prepared by an anionic catalyzed polymerization with a polyester initiator and the polymer is formed from dicarboxylic acid esters and aliphatic polyols and/or aliphatic polyether polyols; as well as through a process comprised of polymerizing together lactams, polyols and polyacyl or acyl polylactams and an alcohol in the presence of a base lactam polymerization catalyst.

The lactam terpolymer as described below is based upon various moieties as components of a block terpolymer. For example, in the embodiment of the lactam-polyol-polyacyl lactam terpolymer, the lactam may be caprolactam, the polyol may be 1,4-butanediol or polyethylene glycol, and the polyacyl lactam may be tetraphthaloyl biscaprolactam or 1,3-benzene disulfonyl caprolactam.

A preferred monomer of the terpolymer is ε-caprolactam. Lactam monomers in addition to ε-caprolactam include alphapyrrolidinone, piperidone, valerolactam, caprolactams other than the ε-isomer, capryllactam, lauryllactam and the like. In addition to lactams unsubstituted on their carbon chains, lactams having substituents on the carbon chain which do not inhibit or otherwise adversely affect the polymerization of the lactam are also included within the scope of this invention.

During polymerization the cyclic lactam ring is opened to provide the following monomeric unit $$-\overset{\overset{\displaystyle O}{\|}}{C}-Y-NH-$$

which, together with other lactam molecules, produces a polymeric block of the formula $$-\left(\overset{\overset{\displaystyle O}{\|}}{C}-Y-NH\right)_x-$$

where x is an integer greater than one. The monomeric lactam unit can also react with the polyacyl alkoxide. Similarly, a polylactam block, when joined with a polyacyl unit forms a polymer segment of the formula $$-\left(\overset{\overset{\displaystyle O}{\|}}{C}-Y-NH\right)_x-(A-R)_b-(A')_y-$$

where R is a hydrocarbon group described hereinbelow, A and A' are acyl groups, x is an integer greater than one, y is an integer equal to or greater than one, and b is an integer equal to zero or one.

In the course of the polymerization of the components described above, a polyol can react with the polymerizable lactam unit or block or product a polymer segment of the formula $$-(O-Z)_n-O-\left(\overset{\overset{\displaystyle O}{\|}}{C}-Y-NH\right)_x-$$

where x and n are integers equal to at least one and where Z is a hydrocarbon, substituted hydrocarbon or acylated hydrocarbon group which, together with the oxygen atom attached thereto, forms a polyether or polyester segment of a polymer molecule. The Z hydrocarbon, substituted hydrocarbon and acylated hydrocarbon groups can be of any size even polymeric such as polybutadiene, generally limited to about six carbon atoms, said groups being preferably alkylene, arylene, alkylene carbonyl, arylene carbonyl, and mixtures thereof. Even more preferred are unsubstituted aliphatic groups such as methylene, ethylene, propylene, butylene and the like. Other suitable Z groups include phenylene, chlorophenylene, tolylene, isobutylene, isopropylene, ethylcarbonyl, propylcarbonyl, ethylsulfonyl, propylthiocarbonyl and the like.

The preference indicated above for unsubstituted aliphatic Z groups means that terpolymers of this invention which contain polyether segments are preferred over other embodiments which contain polyester segments.

In preferred aspects of this invention, it is theorized that the lactam is present in the polymer in the form of polylactam blocks which are alternated with blocks of polyol and polyol segments to form the polymer. The polylactam blocks when present can be of any size but customarily have molecular weights of at least about 500, preferably at least about 1000.

The polymerized polyol components of the polymers of this invention are formed from polyol intermediates having at least two hydroxy groups. Available commercial polyols of this class are produced by reacting, for example, propylene oxide or ethylene oxide with glycols, glycerol, pentaerythritol, glucose, amines, and the like. Included within the scope of the above class are a large number of suitable compounds ranging from the simple diols such as ethylene glycol to complex polymeric polyols such as poly (ε-caprolactone) diol. Other polyol compounds include alkylene glycols such as diethylene glycol, triethylene glycol, tetraethylene glycol, tetramethylene glycol, propylene glycol, dipropylene glycol, hexylene glycol, 1,2-propanediol, 1,3-propanediol, 1,3-hexanediol, 1,5-pentanediol, butylene glycol, 1,4-butanediol, dicyclopentadiene glycol, heptaethylene glycol and isopropylidene bis (p-phenyleneoxypropanol-2); diols other than alkylene glycols such as pyrocatechol, resorcinol, hydroquinone, hydroxyethyl acrylate and hydroxypropyl methacrylate; polyols having more than two hydroxy functions such as glycerol, pentaerythritol, 1,2,6-hexanetriol, 1-trimethylol propane, pyrogallol and phloroglucinol; polymeric polyols such as polyethylene glycols, polypropylene glycols, polyoxypropylene diols and triols, castor oils, polybutadiene glycols and polyester glycols, and a large number of compounds containing substituents other than hydroxy groups such as 2,4-dichlorobutylene glycol and 2,2'-4,4' bis (chlorohydroxyO phenyl) ether. In addition to all the hydroxy compounds set forth above, the thio compounds analogous to the above compounds having sulfur atoms in place of oxygen are also included within the scope of the invention. A few examples include hydroxyethyl thioglycolate, ethylene glycol bis(thioglycolate), pentaerythritol tetrakis-(thioglycolate) and thiodiglycol.

If the polyol intermediate is a polymer, the molecular weight of the polyol can be any amount. Commercially available polymeric polyol compounds have molecular weights from 200 to 5000, but polymers with molecular weights outside that range are also useful in the practice of the instant invention. If the polyol intermediate or segment is a single molecule having at least two hydroxy groups such as ethylene glycol, a suitable polyol segment according to the invention would have a molecular weight of at least 62.

The third component of the terpolymers has the following structural configuration in the polymer chain:

$$-(A-R)_b-(A')_y-$$

where R is a hydrocarbon group, A and A' are acyl radicals, y is an integer equal to at least one, and b is an integer equal to zero or one.

The R group can be any hydrocarbon group having at least two valence bonds for attachment to the acyl groups shown in the above formula. Examples include functional groups obtained by the removal of hydrogen atoms from methane, ethane, propane, hexane, dodecane, benzene, toluene, cyclohexane and the like. The polyvalent R group can be of any size but is preferably limited to about twenty carbon atoms, and more preferably about eight carbon atoms. If the integer "y" is one, the linkage will be a diacyl group. The A group can be any acyl group and preferably are $$-\overset{O}{\overset{\|}{C}}-,\ -\overset{S}{\overset{\|}{C}}-,\ -\underset{\underset{O}{\|}}{\overset{O}{\overset{\|}{S}}}-,\ \text{or}\ -\underset{\underset{|}{}}{\overset{O}{\overset{\|}{P}}}-$$

groups. Most preferred among the above groups is the carbonyl group.

Values for the integer "y" have a direct relationship to the thermoplasticity of the terpolymer. If the integer "y" is greater than one, the linkage will be a higher polyacyl. The higher the value of "y", the more highly crosslinked will be the finished polymer. Values for "y" can be as high as six or eight, but more preferably do not exceed two or three.

The polymerized product comprising the aforementioned components can have a number of different structures depending upon the process conditions and the relative proportions of ingredients used in the reaction system. Polymers can be prepered having relatively small segments of lactam units joined to similarly short segments of polyol units through the polyacyl linkage described above. Or large segments of one polymeric component can be combined with a larger number of comparatively small segments of another polymeric unit, which small segments are joined to one another through the polyacyl linkage as well as to the other type of polymeric component. Or segments of varying sizes of both the lactam and the polyol polymeric units can be combined through the polyacyl components to form a highly random terpolymer. Another form of polymer within the scope of this invention are block polymers, where moderately large size blocks or segments of the lactam and polyol polymeric units are positioned alternately in the polymer chain and joined through the polyacyl group described above. If the polyacyl linkages are, for purposes of simplification, considered to be a part of either a lactam or polyol block, then the block polymers of this invention can be discussed in terms of two alternating blocks designated as A and B blocks, instead of in terms of complicated patterns of three blocks designated as A, B and C blocks. Block polymers prepared according to this invention can have three general structural configurations, AB, ABA and a repeating pattern of AB segments. Following a general characterization of a block copolymer prepared within the scope of this invention as AB, ABA or repeating AB, it should be recognized that the exact structural configuration may vary somewhat from the general characterization of the polymer. As an illustration, one theoretical formula for a lactam-polyolpolyacyl lactam block terpolymer of the repeating AB type could be $$R'-O-\left[\left(\overset{O}{\overset{\|}{C}}-Y-NH\right)_x-(A-R)_b-(A')_y-\left(NH-Y-\overset{O}{\overset{\|}{C}}\right)_{x'}-(O-Z)_n-O\right]_w-(A-R)_b-(A')_y\left(NH-Y-\overset{O}{\overset{\|}{C}}\right)_{x''}-O-R'$$

where y, x, x', x'', n and w are all integers equal to one or more; b is an integer equal to zero or one; R is a divalent or polyvalent hydrocarbon group; $(O\text{-}Z)_n$ is a polyol segment or a polymeric moiety and Z is a hydrocarbon or substituted hydrocarbon group; Y is an alkylene group having at least three carbon atoms; A and A' are acyl groups; and R' is an aliphatic or substituted aliphatic hydrocarbon wherein the ester group is attached to other than an aromatic radical.

If for instance Y is a straight chained alkylene group, A and A' are carbonyl groups, Z is ethylene, $-CH_2CH_2-$, and R is phenylene, the terpolymer would be a caprolactam-ethylene glycol polymer where the caprolactam segments of the polymer are joined to one another and to the ethylene glycol segments through terephthaloyl linkages. Other lactam-polyol polymers, both of the AB, ABA as well as the repeating AB type, will become immediately apparent to those skilled in the art in view of this disclosure. It should therefore be noted that the above structural formula is set forth for illustrative purpose only, and is not intended as a limitation of the polymers within the scope of the invention.

When the polymers of this invention are of the ABA type, where one block of one type of polymer segment is located between two blocks of the other type of polymer segment, the polymers can be of either the polyol-lactam-polyol type or the lactam-polyol-lactam type. Of the two types, the latter is a preferred type of ABA polymer.

If the lactam-polyol-polyacyl lactam polymer is a block polymer, the polyol blocks can, like the polylactam blocks, be of any size but customarily have molecular weights of at least about 500, preferably at least about 1000. The ratio of the number of lactam to polyol blocks can also vary. Since the block polymers can be of either the type designated as AB, ABA or repeating AB, the ratio of lactam blocks to polyol blocks can vary from 2:1 to 1:1 to 1:2. Mixtures of two or more block polymers having different ratios of the lactam and polyol blocks will produce ratios of polymer blocks intermediate between the above stated ratios.

In the above theoretical formula for a lactampolyol block terpolymer, the polyacyl linkage is represented as located between two lactam polymer segments as well as between a polyether segment and a lactam polymer segment. As a practical matter, the polyacyl linkages will also be located occasionally between two polyol blocks. It should be noted, moreover, that the polyacyl linkages need not invariably be psoitioned between lactam and polyol blocks since the necessary linkage can be provided in the form of an ester linkage by the oxygen atom of the polyether segment and the carbonyl group of a polylactam segment.

Following is a general characterization of the lactam polyol-polyacyl lactam terpolymer produced according to the invention. As an illustration, the lactam-polyol-polyacyl lactam or acyl polylactam terpolymer has the general formula:

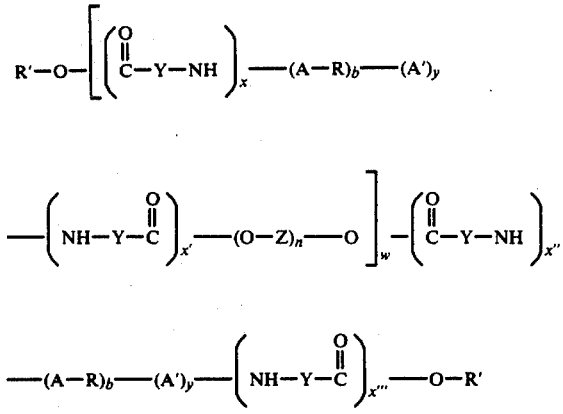

Wherein $(O\text{-}Z)_n$ is a polyol segment or a polymeric moiety and Z is a hydrocarbon or substituted hydrocarbon group said group being alkylene, arylene, alkylene carbonyl, arylene carbonyl, and mixtures thereof;

A and A' are acyl groups selected from

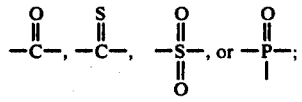

R is a polyvalent hydrocarbon group;

Y is an alkylene or substituted alkylene having from about 3 to about 14 carbon atoms;

y is an integer equal to at least one, and b is an integer equal to zero or one; x, x', x'' and x''' are integers and the total number of x's is equal to 2w+2; and n and w are integers equal to one or more.

What is claimed is:

1. A process for bonding fibers to produce nonwoven fabrics comprising forming fibers from a melt blend comprising a polyamide and a lactam-polyol-polyacyl lactam or acyl polylactam terpolymer wherein the melt blend has at least about 0.1 weight % polyol based on the weight of the melt blend and contacting the said fibers at a temperature of from 20° C. to 250° C.

2. The product produced by the process of claim 1.

3. A process for contact bonding fibers comprising forming fibers from a melt blend comprising a polyamide and a lactam-polyol-polyacyl lactam or acyl polylactam terpolymer wherein the melt blend has at least about 0.1% by weight polyol based on the weight of the melt blend, and contact bonding the fibers in a nascent and substantially amorphous state, without substantial application of pressure at a temperature of 20° C. to 210° C.

4. The process according to claim 3 wherein the contacting of the fibers in the nascent and substantially amorphous state is preceded by exposure to water.

5. A process according to claim 3 wherein the crystallization of the contacted fibers is promoted by annealing at a temperature which is from 10° C. to 150° C. above the bonding temperature.

6. The product produced by the process of claim 3 wherein non-woven fabric results from the contact bonding of the nascent and substantially amorphous fibers.

7. The process according to claim 3 wherein the melt blend is comprised of the lactam terpolymer and nylon 66.

8. A process for retarding the crystallization of melt blended polyamide fibers comprising: melt spinning a melt blend comprising a polyamide and a lactam-polyol-polyacyl lactam or acyl polylactam terpolymer wherein the melt blend comprises at least about 0.1% by weight polyol content is provided by said terpolymers.

9. A process for bonding the crystalline form of melt blended fibers comprising a polyamide and a lactam-polyol polyacyl lactam or acyl polylactam terpolymer wherein the melt blend comprises at least about 0.1% by weight polyol content based on the weight of the melt blend, comprising thermally bonding the fibers at a temperature of 200° C. to 250° C.

10. The process according to claim 9 wherein the contacting of the fibers is preceded by exposure to water.

11. The product produced by the process of claim 9.

12. The process according to claim 9 wherein the melt blend is comprised of a lactam terpolymer and nylon 66.

13. A process of producing a composite article which comprises forming a melt stream of a melt blend comprising a polyamide and a lactam terpolymer, which melt blend has at least 0.1 wt. % polyol content based on the weight of the melt blend, forming a melt stream of another polymeric substance, and extruding the said two melt streams together in a composite configuration, the said composite configuration having at least 5% by wt. of the said melt blend in the total composite article.

14. The product produced by the process of claim 13.

15. A process of producing a sheath core composite fiber which comprises forming a melt stream of a melt blend comprising a polyamide and a lactam terpolymer, which melt blend has at least 0.1 wt. % polyol content based on the weight of the melt blend, forming a melt stream of another polymeric substance, and extruding the said two melt streams together in a sheath core configuration, of a sheath and a core, the said composite sheath core fiber having at least 5% by weight of the said melt blend in the said total composite fiber.

16. The sheath core fiber product of claim 15 in which the melt blend comprising the lactam terpolymer and the polyamide is the sheath and the other polymeric substance is the core.

17. The sheath core fiber product of claim 16 in which the melt blend comprising the lactam terpolymer and the polyamide is the sheath and polyethylene terephthalate is the core.

18. A process according to claim 15 in which the polyamide is nylon 66.

19. A process of producing a nonwoven fabric which comprises bonding at a temperature of 20° C. to 250° C. the sheath core fibers produced by the process of claim 15.

20. The product produced by the process of claim 19.

* * * * *